US007744054B2

(12) United States Patent
Xammar Bove

(10) Patent No.: US 7,744,054 B2
(45) Date of Patent: Jun. 29, 2010

(54) DEVICE TO AID THE UNLOADING OF SUPPORT ELEMENTS

(75) Inventor: Pedro Xammar Bove, Montcada I Reixac (ES)

(73) Assignee: Inveral, S.A., Barcelona (ES)

( * ) Notice: Subject to any disclaimer, the term of this patent is extended or adjusted under 35 U.S.C. 154(b) by 585 days.

(21) Appl. No.: 11/663,193

(22) PCT Filed: Sep. 1, 2005

(86) PCT No.: PCT/EP2005/009422

§ 371 (c)(1),
(2), (4) Date: Mar. 19, 2007

(87) PCT Pub. No.: WO2006/032351

PCT Pub. Date: Mar. 30, 2006

(65) Prior Publication Data

US 2008/0073474 A1 Mar. 27, 2008

(30) Foreign Application Priority Data

Sep. 20, 2004 (ES) ..... 200402236

(51) Int. Cl.
*A47F 5/00* (2006.01)

(52) U.S. Cl. ..... 248/354.4; 248/354.3; 248/351; 52/149; 403/109.5

(58) Field of Classification Search ..... 248/354.3, 248/354.4, 354.6, 351, 222.13, 228.2, 229.21, 248/229.11; 52/146, 149, 150; 182/69.4; 403/109, 374, 109.1, 109.2, 109.3, 109.4, 403/109.5, 109.6, 109.7, 109.8, 379.4, 378, 403/FOR. 100, FOR. 102; 269/63, 69; 254/102, 254/133 R, 134
See application file for complete search history.

(56) References Cited

FOREIGN PATENT DOCUMENTS

| | | |
|---|---|---|
| DE | 631 013 | 6/1936 |
| DE | 649 481 | 8/1937 |
| FR | 1 089 158 | 3/1955 |

*Primary Examiner*—A. Joseph Wujciak, III
(74) *Attorney, Agent, or Firm*—Sughrue Mion, PLLC

(57) ABSTRACT

A device to aid the unloading of support elements, the support elements comprising a lower shaft and an upper shaft telescopically coupled to each other. The device includes annular first and second bodies coaxially couplable with each other. Each annular body is provided with a through-hole that allow the upper shaft to extend through the through holes. The upper shaft is also supported by the first annular body using a transversely extending member. The second annular body rests on the lower shaft. An intermediate unloading wedge is positioned between the first and the second annular bodies coupled together, and is able to slide transversally with respect thereto. The sliding of the unloading wedge causes the first annular body and the second annular body to come together or move apart in the longitudinal direction and, therefore, reduce or increase, respectively, the total length of the support element.

15 Claims, 6 Drawing Sheets

DEVICE TO AID THE UNLOADING OF SUPPORT ELEMENTS

This application is a 371 of PCT/EP2005/009422, filed Mar. 19, 2007; the disclosure of which is incorporated herein by reference.

TECHNICAL FIELD OF THE INVENTION

The invention relates to a device for unloading support elements, applicable to props for construction or falsework, of those formed by two telescopically coupled tubular elements, which aids the support element to uncouple quickly and easily from the formwork element or from the constructive element that it supports.

BACKGROUND OF THE INVENTION

Props are vertical support elements whose height can be adjusted, normally used in construction, comprised of a vertical exterior base tube, known as the lower shaft, which has a support base at its lower end and an interior tube, or upper shaft, that is removable to a lesser or greater extent from the lower shaft to adapt the length of the prop to the distance between the surfaces or elements to be supported by the prop, such as formwork elements.

The props are provided with fastening means that allow the position of the upper shaft to be fixed, once it has been extracted enough from the lower shaft (base tube). These means are normally comprised of a transversal pin that passes through the upper shaft and that at the same time rests on an adjusting nut with handles and attached to the thread that the upper end of the lower shaft has externally.

When the structure that supports the prop on the site has acquired sufficient resistance, the prop is unloaded, i.e. the prop is uncoupled from the formwork element that it supports. To uncouple the prop it is very difficult to manually loosen the adjusting nut in the opposite direction to that of adjustment, since the pressure that the loaded prop is under hinders the turning of said nut with respect to the thread of the lower shaft. It is usual therefore, that the operator hits the nut handles with a hammer or similar, in the direction to loosen it, but this is often the cause of faults in the props. Therefore, to aid the unloading manoeuvre, devices are used for the rapid unloading of props.

Devices are known to aid the unloading of support elements, such as props, based on parts connected to the upper end of said prop, wherein the upper edge has indentations that have a straight step, determining an appreciably horizontal area for the support of a transversal pin that passes through the upper shaft, this state corresponding to the operative or working position of the prop. The parts in question have a recess adjacent to the step, this recess being designed to receive the pin during the descent or fall thereof in the unloading position of the prop. This type of devices for aiding the unloading have the drawback that, due to an accident or a bad manoeuvre, the pin can move towards the edge of the step falling in the recess, which causes the unloading of the prop whilst in working position and the dangers that this involves. Also, to unload the prop, it is necessary to hit the pin strongly so that this falls into the recess, due to the lack of inclination of the surface wherein it is initially supported since if it were more inclined it would increase the risk of the pin accidentally falling in the recess.

Another example of embodiment of a device to aid the unloading of props is disclosed in document ES 2140280, wherein it provides a sliding holder on the prop shaft, that is supported by the adjusting nut and which has two indentations diametrically opposite one other, each one having on one of its sides a sloping step, the bottom of the indentation being rounded, adapted to receive the prop pin. The device is complemented by another part, a sliding cylindrical device on the exterior of the prop shaft, which holds different diametrically opposite extensions, which can fit, for the operative position of the prop, in the holder indentations, preventing the accidental falling of the pin therein. Thus, to aid the unloading of the prop, it is necessary to elevate the cylindrical element, so that the extensions come away from the bottom of the indentations and therefore the pin can slip, due to gravity or being hit, in the sloping step until it penetrates the bottom of the indentations.

In said device to aid the unloading of props, it is necessary to first position the holder, then put the pin through the upper shaft of the prop and keep this supported on the sloping step of the holder, until the complementary part has been positioned on top so that its extensions fit into the bottom of the holder indentations, which complicates the construction of the unit.

The lack of a device for unloading support elements such as props or falsework, that overcomes the drawbacks of the existing devices and that improves the speed and ease of the positioning thereof, is therefore evident.

EXPLANATION OF THE INVENTION

The device for unloading support elements object of the invention, is applicable to falsework or to props comprised of two tubular elements, a lower shaft and an upper shaft, telescopically coupled.

In essence, the device for unloading support elements is characterized in that it is comprised of one essentially annular first and second bodies coaxilally couplable, each body provided with a through-hole adapted so that when both bodies are duly coupled the upper shaft of the support element can pass through, which can rest on said first body, being able the second body to rest on the lower shaft; and an intermediate unloading wedge being positioned between both bodies coupled together, able to slide transversally with respect thereto and so that its sliding causes, when the support element is in a vertical position, the first body and the second body to come closer together or further away in the longitudinal direction of the support element and, therefore, a decrease or increase, respectively, in the total length of the support element.

According to another characteristic of the invention, the intermediate unloading wedge has retaining means adapted to block its position with respect to the two bodies and thus fix a separation distance between said bodies, corresponding to the operative position of the support element, so that when the position is unblocked, the separation distance between both is reduced, and the support element returns to an inoperative position.

According to another characteristic of the device to aid the unloading of support elements, each one of the essentially annular bodies has a diametrically opposite first projection and a second projection, that originating from the internal base of the annular body, extend perpendicularly thereto in equal proportions, their opposite internal faces forming different cylindrical surfaces coaxial with the one with the through-hole, the exterior edge of each projection having the respective and corresponding transversal protuberance, cantilevered, underneath which there is a corresponding cavity, all of this adapted so that, once both bodies are coupled, the transversal protuberances can simultaneously fit into the respective cavities of the other body, which have bases, made on the internal face of each annular body, adapted to receive the support of the projection from the other body and the corresponding transversal protuberance, as both bodies are capable of moving axially between themselves, abandoning the support in said bases when the device passes from the inoperative position to the operative position.

According to another aspect of the invention, the bases have vertical end stop portions, adapted to limit the mutual turning of the first body and of the second body when they are coupled.

According to another characteristic of the invention, the intermediate unloading wedge consists of an annular flattened oblong body, with two straight, longitudinal and parallel sides and two arched end portions, said parallel sides being decreasing quadrangular sections, so that the straight sides have their upper and/or lower faces forming a wedge.

According to a preferred embodiment, the annular bodies have on the opposite faces, when both bodies are coupled with an interposition of the intermediate unloading wedge, a sloping exterior surrounding surface corresponding to the upper and lower faces of the straight sides of the intermediate unloading wedge.

According to another feature of the invention the vertical stop portions of each body are respectively coplanar with the surfaces of the opposite interior faces of the straight sides of the intermediate unloading wedge.

According to another characteristic of the invention, the first projection and second projection of each annular body have respectively, in the sides opposite the transversal protuberances, a first and a second bevelled surface parallel to the surfaces of the opposite interior faces of the two straight sides of the intermediate unloading wedge, so that said bevelled surfaces have guide devices for the intermediate unloading wedge when this slides between the two annular bodies, at the same time that said bevelled surfaces of the same body are guided by the vertical end stop portions of the bases of the other annular body to which it is attached.

According to another characteristic of the invention, at least the first projection of each annular body is included in the opposite face of the face with the transversal protuberance of a third bevelled surface, which is attached to the first bevelled surface.

According to another aspect of the invention, one of the arched ends of the intermediate unloading wedge has a peripheral groove whose ends coincide with two through-holes made in the straight sides of the intermediate unloading wedge.

According to another characteristic of the invention, the retaining means are positioned in the peripheral groove on the intermediate unloading wedge.

According to another preferred embodiment, the retaining means are made of a retention spring that is comprised of an arched portion, adapted to be positioned in the peripheral groove of the intermediate unloading wedge, and some ends that are folded inwards, which are designed to fit into the through-holes of the intermediate unloading wedge.

According to another characteristic of the invention, in the operative position of the support element the third bevelled surfaces of the first projections of each annular body are comprised of non-return means for the retaining means of the intermediate unloading wedge, so that you can only unblock said operative position by applying force perpendicularly on the exterior face of the arched end portion of the intermediate unloading wedge with a peripheral groove capable of overcoming the retention force that the retaining means exert.

According to another characteristic of the invention, the arched end portion of the intermediate unloading wedge with a peripheral groove has a widened surface which is adapted to receive the application of a force in a direction essentially perpendicular to the support element.

BRIEF DESCRIPTION OF THE DRAWINGS

The drawings illustrate, by way of non-limiting example, a preferred embodiment of the device object of the invention. In said drawings.

DETAILED DESCRIPTION OF THE DRAWINGS

Figure 1:
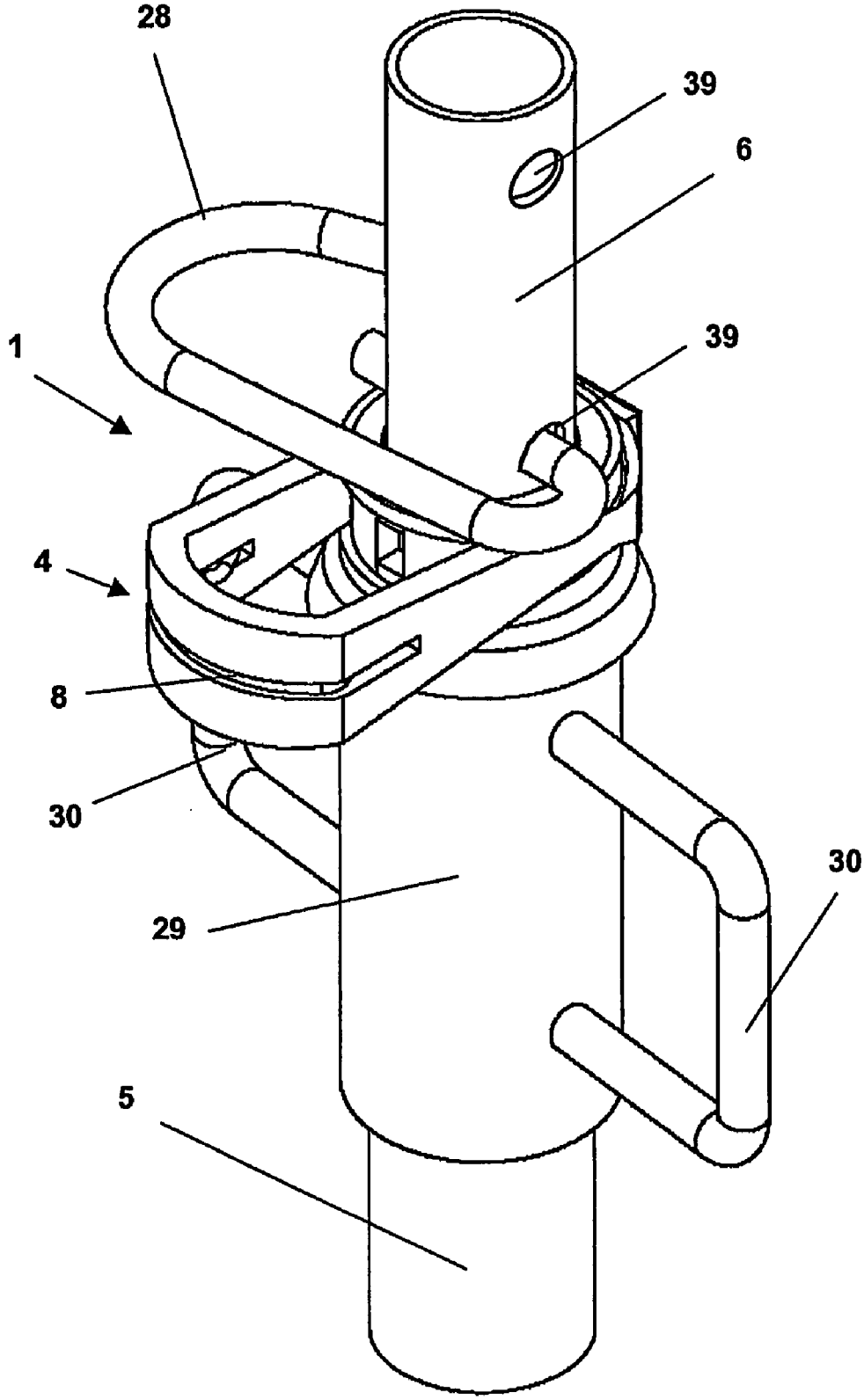
FIG. 1, is a perspective view of a section of the prop with the device to aid the unloading of props object of the invention, in inoperative position.

FIG. 1 is a perspective view of a section of the support element, in the example of the drawing a prop, with the device to aid unloading 1 of the support elements object of the invention, in operative position.

The prop represented is basically comprised of two telescopically coupled tubular elements, known as lower shaft 5 and upper shaft 6. The lower shaft 5 is a vertical exterior base tube, which has a support base at its lower end, not shown on the drawing, and which has a thread at its upper end. This thread is connected to the interior thread of an adjusting nut 29.

The upper shaft 6 is an inner tube that can be removed to a varying degree from the lower shaft 5 and has through-holes 39 distributed diametrically opposite throughout the length of said upper shaft 6. In general, the upper shaft 6 also has a support at its upper end, not represented in FIG. 1, configured as a horizontal platform, whereby the prop supports the formwork elements or other constructive elements on construction sites that require provisional support.

So that the prop enters in load, i.e. receives the load of the elements that it has to support, the length of the prop must be adjusted to the distance between said elements to be supported, the upper shaft 6 being extracted to a greater or lesser extent from the lower shaft 5. For this, the props are provided with fastening means that allow them to fix the position of the upper shaft 6 once this has been removed axially to a sufficient degree from the lower shaft 5. To adjust the length of the prop, a pin 28 is introduced transversally in one of the through-holes 39 of the upper shaft, so that the section extracted from the upper shaft 6 is as close as possible to the element to be supported by the prop. Once the pin 28 has been inserted, the latter is normally supported by gravity on the upper surface of the adjusting nut 29. Thus, you finish adjusting the length of the prop by turning the adjusting nut 29 by its handles 30 so that the coupling by threads between the adjusting nut 29 and the upper end of the lower shaft 5 drags the pin 28 in its ascent and therefore also the upper shaft 6.

When the upper end of the upper shaft 6 comes into contact with the element to be supported, it is said that the prop enters in load, i.e. it is in operative position. Once the concrete of the element to be supported has acquired sufficient resistance to be able to take down the formwork, the prop is unloaded, wherein the upper shaft 6 has to separate from the constructive element that it supports. So that the prop unloads and enters an inoperative position, devices are used to aid the unloading, that quickly cause the shortening of the length extracted from the upper shaft 6, subsequently aiding the turning of the adjusting nut in the opposite direction to the tightening, by subjecting the prop to the compression generated by the load that it supported previously.

The terms operative position and inoperative position are applicable both to the prop and the device to aid the unloading 1 object of the invention. Operative position is understood to mean that position wherein the prop is loaded, and inoperative position when it is no longer loaded and it is free of the element that it supports.

Figure 2:
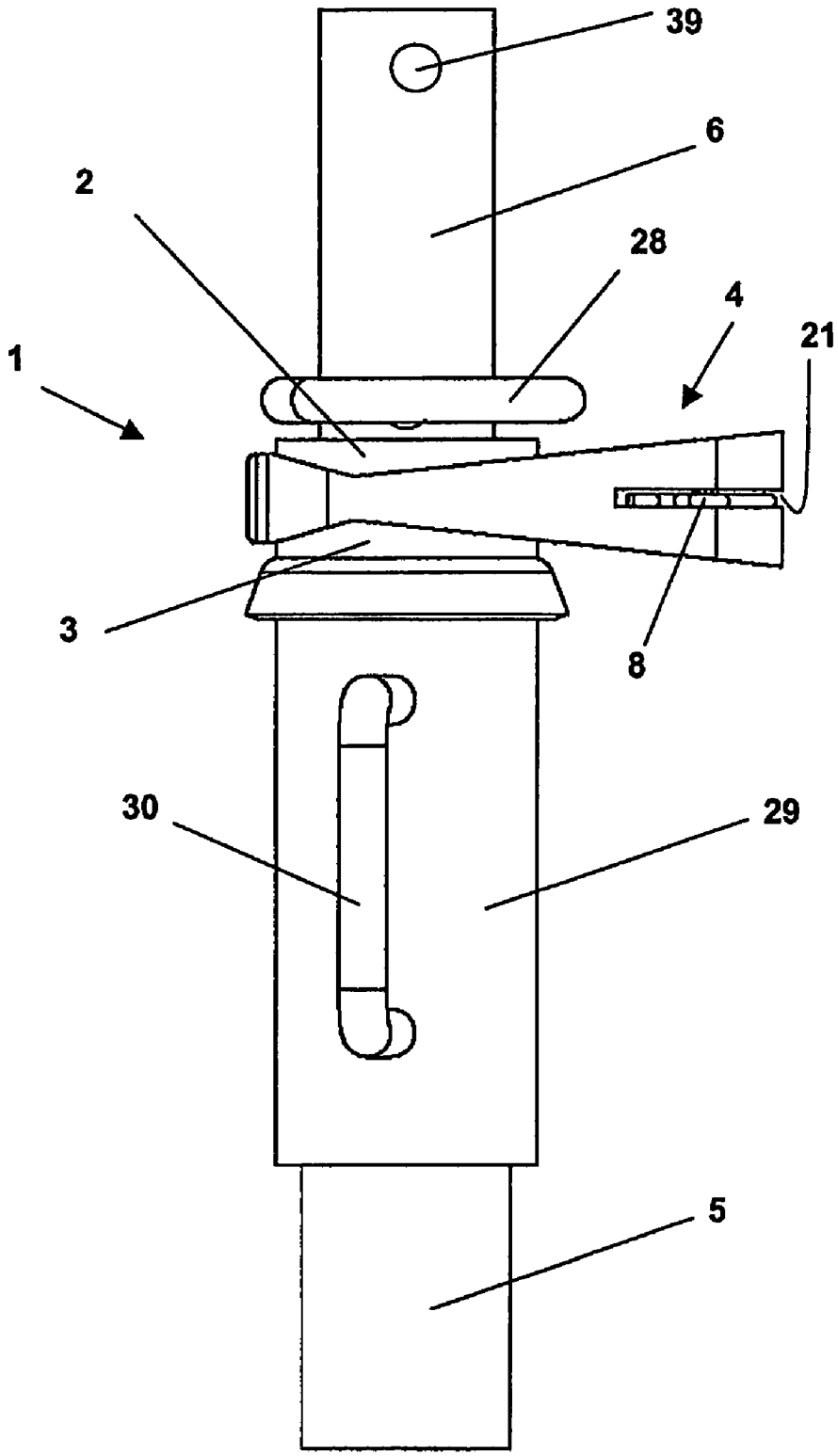
FIG. 2, is a side view of the section of the prop of FIG. 1.

FIGS. 1 and 2 show that the device to aid the unloading 1 is positioned between the upper surface of the adjusting nut 29 and the pin 28, so that the device to aid the unloading receives by gravity the support thereof.

The device to aid the unloading 1 of props shown in the drawings has a first body 2 and a second body 3 that are identical, essentially annular, and have a through-hole 7 adapted for the upper shaft 6 of the prop to pass through and which can be coaxially coupled. The device to aid the unloading 1 further comprises an intermediate unloading wedge 4, positioned between both bodies 2 and 3 coupled together, that slides over the prop perpendicularly to its longitudinal axis.

When the intermediate unloading wedge 4 slides between the first body 2 and the second body 3, it causes said bodies to respectively come together and then move apart in the direction of the prop axis, therefore the distance between the two upper surfaces of the adjusting nut 29 and the pin 28 varies. The intermediate unloading wedge 4 has retaining means 8 adapted to block the unloading shaft in a certain position with respect to the two bodies 2 and 3 and, therefore, fix the separation distance between said bodies, a position that corresponds to the operative position of the prop, so that when said position is unblocked, the separation distance between the two bodies is reduced, and the prop returns to its original inoperative position wherein the reduction of the distance between the two bodies 2 and 3 is sufficient to allow the prop to unload and uncouple from the element that it supports.

Figure 6:
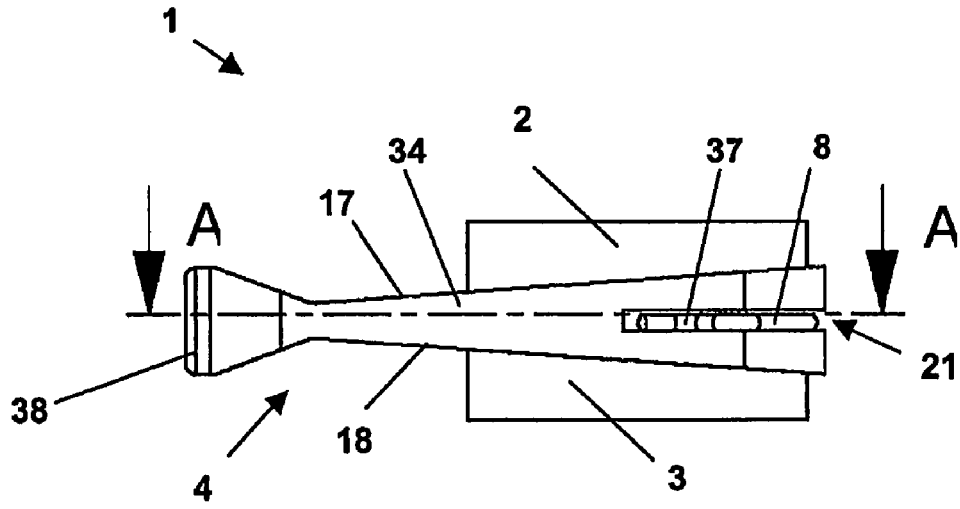
FIG. 6, is a cross-section of the device to aid the unloading of props in operative position.

In FIGS. 1 and 2, the device to aid the unloading 1 of props is in inoperative position. The operative position of the device to aid the unloading 1 is shown in FIG. 6, wherein the prop is not shown. Comparing FIGS. 2 and 6, you can see the difference in the separation distance between the first body 2 and the second body 3.

Each one of the essentially annular bodies 2 and 3 has a first projection 9 and a second projection 10 diametrically opposite one another that, originating from the internal base of the annular body, extend perpendicularly therefrom to an equal length, their opposite internal faces configuring cylindrical surfaces 32 coaxial with a through-hole 7.

Figure 3:
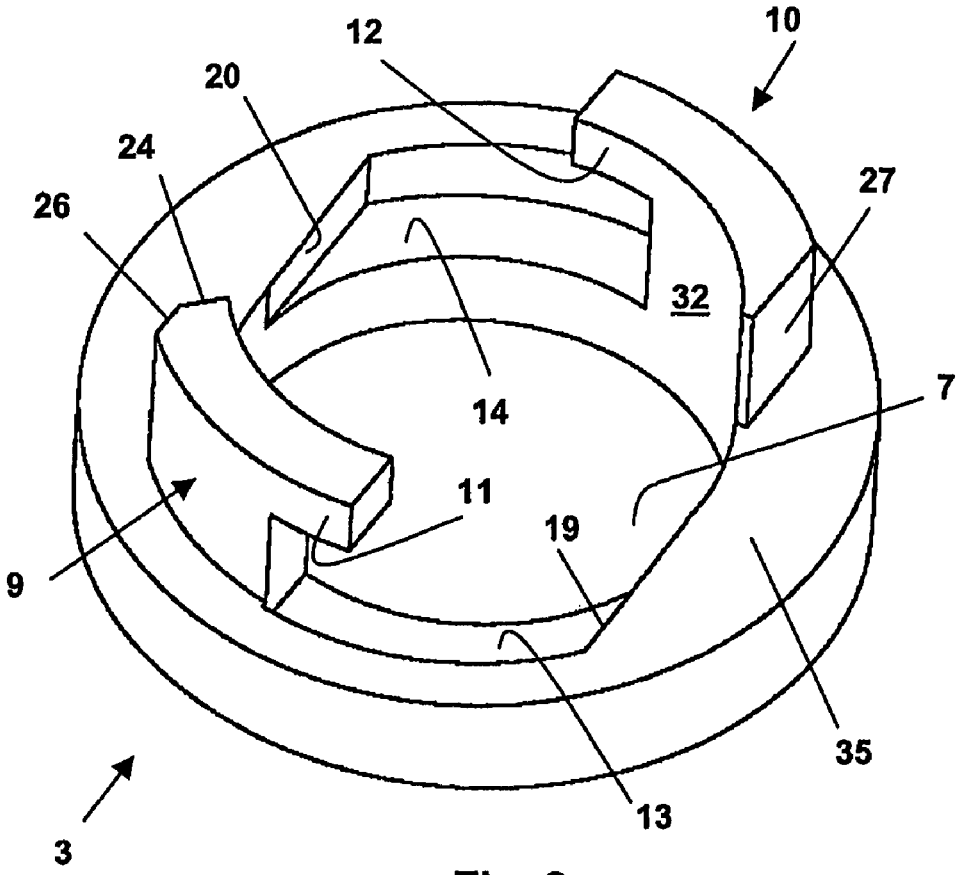
FIG. 3, is a perspective view of the second body that forms part of the device to aid the unloading of props object of the invention.
Figure 4:
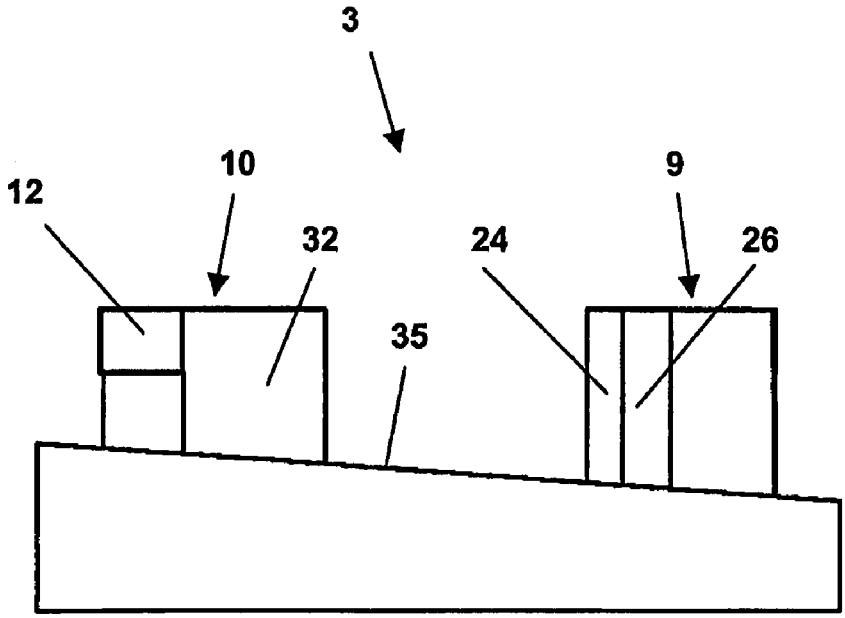
FIG. 4, is a cross-section of the second body of FIG. 3.

Furthermore, as you can see in FIGS. 3 and 4, the exterior edge of each projection 9 and 10 has a corresponding and respective transversal protuberance 11 and 12, cantilevered, underneath which there is a corresponding cavity, so that, once both bodies 2 and 3 are joined together, the transversal protuberances 11 and 12 of a body simultaneously fit together fairly loosely in the respective cavities of the other body, and are supported by the bases 13 and 14 made in the internal face thereof, and vice versa. These bases 13 and 14 of each body are adapted to receive the support of the projections 9 and 10 and of the corresponding transversal protuberances 11 and 12 of the other body, and the bodies 2 and 3 are capable of moving axially between themselves, so that the projections 9 and 10 and the transversal protuberances 11 and 12 leave the support of the bases 13 and 14 when the device passes from inoperative position to operative position.

Figure 8:
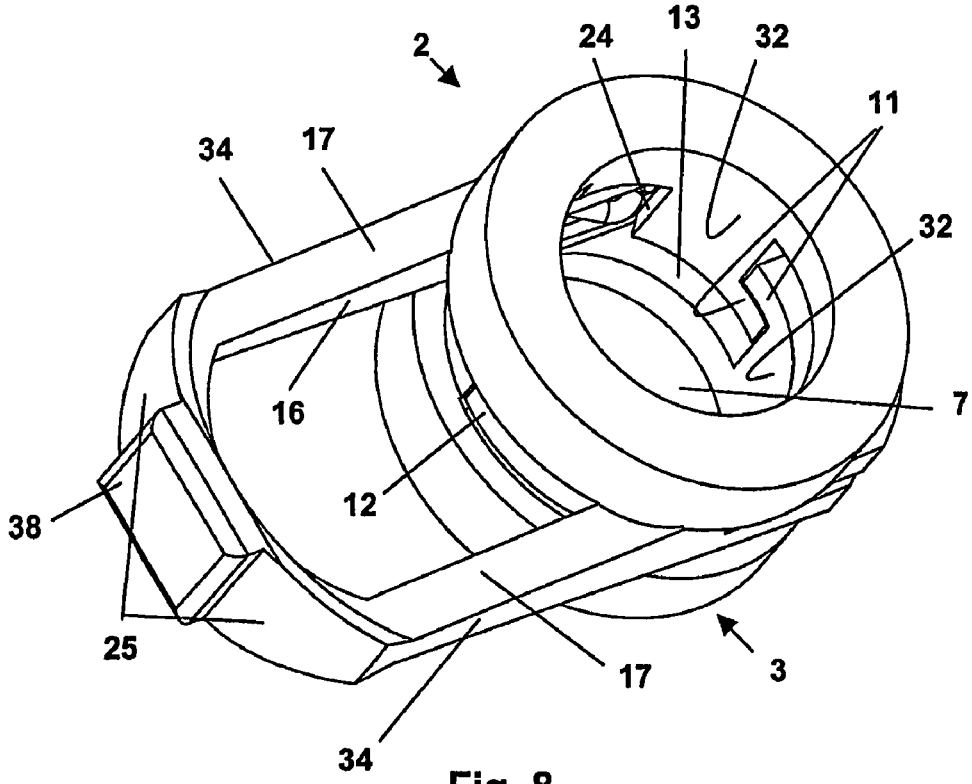
FIG. 8, is a perspective view of the device to aid the unloading of props of FIG. 6.

FIG. 8 represents the device to aid the unloading 1 of props in operative position. In said FIG. 8 you can see that between the transversal protuberances 11 and 12 of the first body 2 and the second body 3, there are no separations preventing, when knocking against each other, that the bodies 2 and 3 keep separating axially from one another. Equally you can see that in operative position, the bases 13 and 14 do not have the support of the ends of each projection 9 and 10 and of their respective transversal protuberances 11 and 12.

On the other hand, the bases 13 and 14 have vertical parts 19 and 20 of end stops, adapted to limit the mutual turning of the bodies 2 and 3 when coupled. Thus, once the upper shaft 6 of the prop has been inserted in the through-hole 7, there is no way that the first body 2, the second body 3 and the intermediate unloading wedge 4 can become uncoupled.

Figure 5:
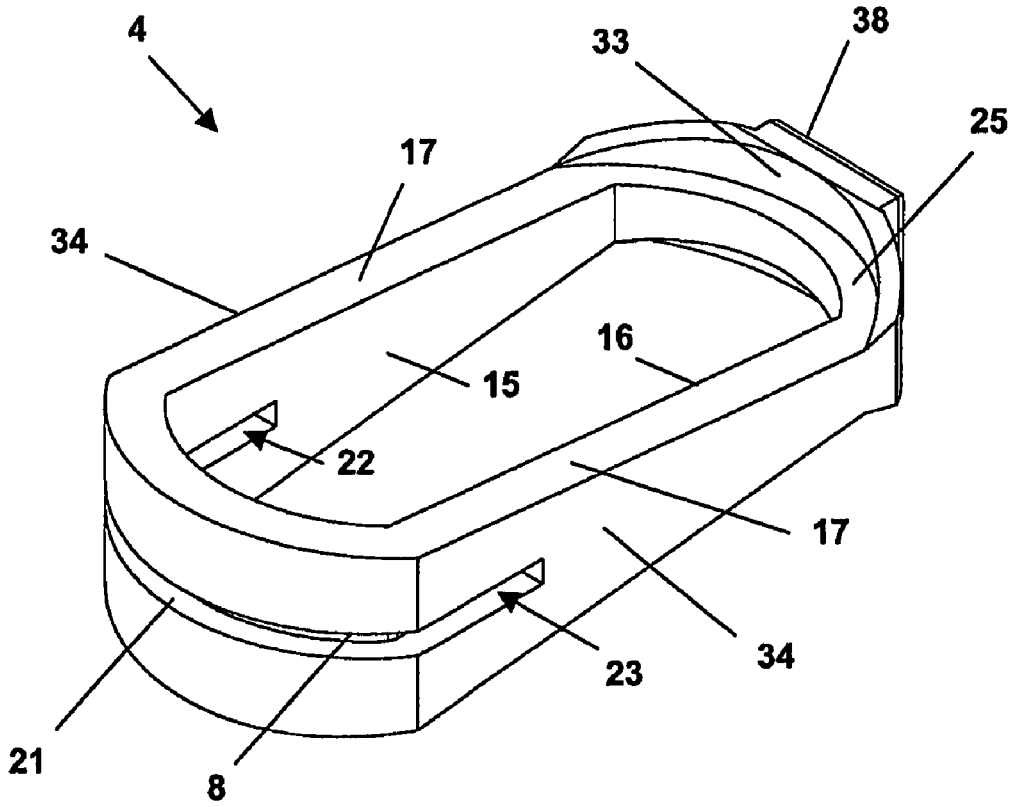
FIG. 5, is a perspective view of the intermediate unloading wedge that forms part of the device to aid the unloading of props according to FIG. 1.

FIG. 5 is a perspective view of the intermediate unloading wedge 4. The intermediate unloading wedge 4 is a flat, oblong, annular body, with two straight, longitudinal and parallel sides 34, and has two arched ends 25. The straight sides 34 are of a decreasing quadrangular section, so that its upper 17 and lower 18 faces form a wedge, as you can see in FIGS. 5 and 6.

On the other hand, the first body 2 and the second body 3 are provided with on the opposite sides, when both bodies are coupled and interposed by the intermediate unloading wedge 4, a surrounding exterior surface 35, sloping in correspondence to the upper 17 and lower 18 faces 17 of the straight sides 34 of the intermediate unloading wedge 4. It should be noted that, naturally, both faces 17 and 18 can slope with respect the horizontal, as shown in the drawings, or that, optionally, only one of them could be sloping.

FIG. 3 further shows that the vertical stop portions 19 and 20 of each body 2 and 3 are respectively coplanar with the surfaces of the opposite interior faces 15 and 16 of the straight sides 34 of the intermediate unloading wedge 4, not shown in said FIG. 3.

Furthermore, the first projection 9 and the second projection 10 of each body 2 and 3 have, on the opposite sides to the faces with the transversal protuberances 11 and 12, first and second bevelled surfaces 26 and 27 parallel to the surfaces of the interior opposite faces 15 and 16 of the straight sides 34 of the intermediate unloading wedge. The first and second bevelled surfaces 26 and 27 comprise guide means for the intermediate unloading wedge 4 when the latter slides between the two bodies 2 and 3, at the same time as said bevelled surfaces in each body are guided, respectively, through the vertical portions 19 and 29 of the bases 13 and 14 of the other body to which it is coupled.

Figure 7:
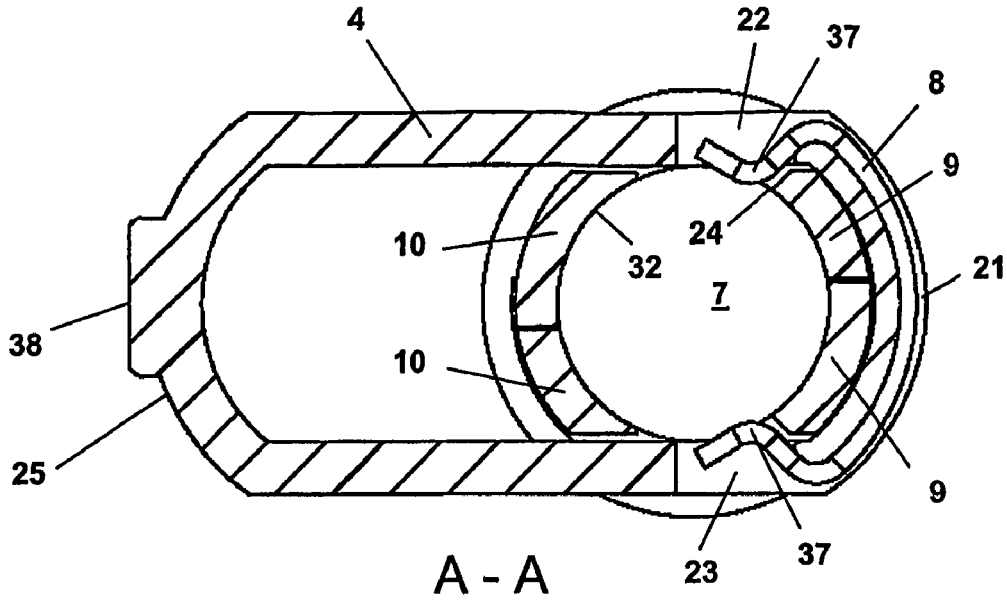
FIG. 7, is a section view according to the cut A-A of FIG. 6.
Figure 9:
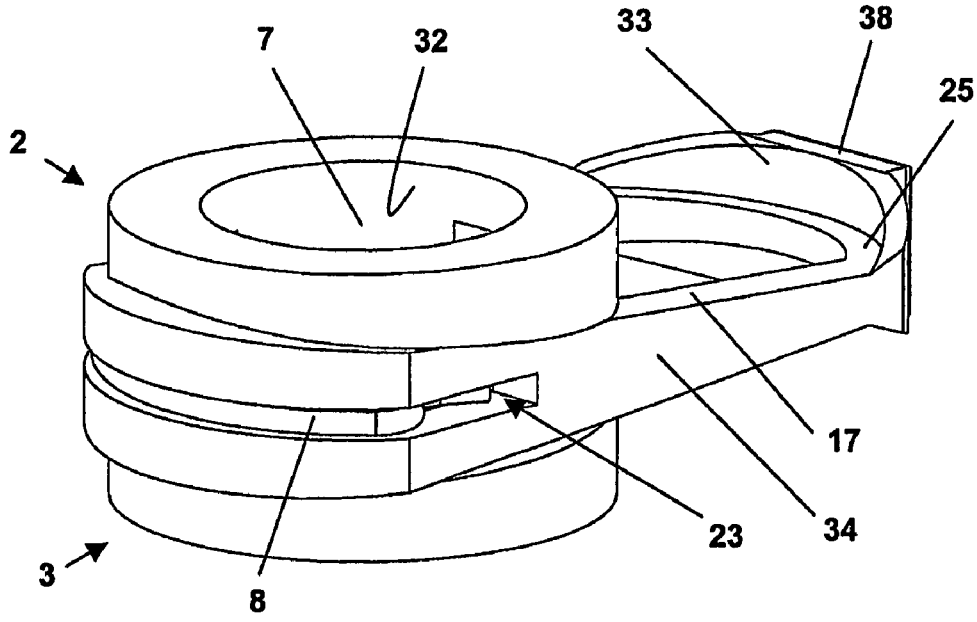
FIG. 9, is another perspective view of the device to aid the unloading of props of FIG. 6.

FIGS. 5 and 6 show that one of the arched ends of the intermediate unloading wedge 4 has a peripheral groove 21 whose ends coincide with the through-holes 22 and 23 made in the straight sides 34 of the intermediate unloading wedge 4. FIGS. 7, 8 and 9 also show that the retaining means 8 are housed in said peripheral groove 21.

Figure 10:
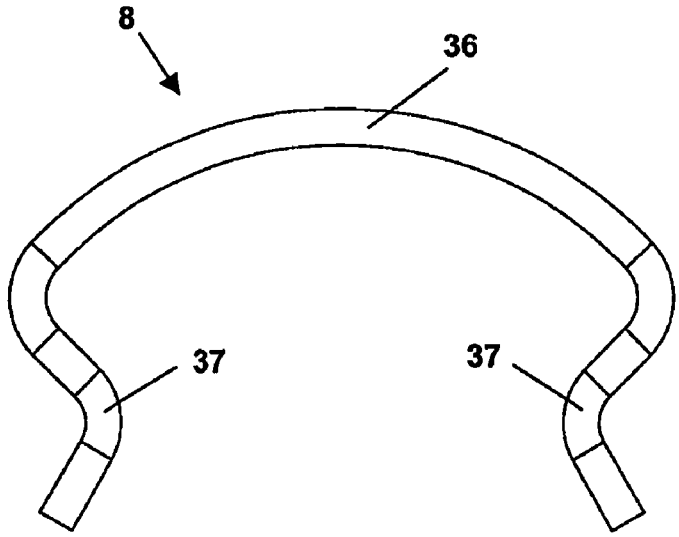
FIG. 10, is a plan view of the retaining means of the device to aid the unloading of props object of the invention.

The retaining means 8 represented in the drawings are comprised of a retention spring that has an arched portion 36 and ends that are folded inwards 37, as you can see in FIG. 10.

The arched portion 36 is adapted so that it can be positioned in the peripheral groove 21 of the intermediate unloading wedge 4, and the ends that are folded inward 37 are designed to fit in the through-holes 22 and 23 of the intermediate unloading wedge. This arrangement of the retaining means 8 is that which is shown in FIGS. 7, 8 and 9.

In the operative position of the prop, third bevelled surfaces 24 of the first projections 9 of each annular body 2 and 3 comprise non-return means for the retaining means 8 of the intermediate unloading wedge 4, by retaining the ends that are folded inwards 37 in said operative position. Thus, the only way to unblock said operative position is by applying a force, in an essentially perpendicular direction with respect to the exterior face of the arched end portion 25 of the intermediate unloading wedge 4 which has a peripheral groove 21, capable of overcoming the retention force that the retaining means 8 exert.

As you can see in FIG. 8, the arched end portion 25 of the intermediate unloading wedge 4, which has a peripheral groove 21, has a widened surface 38. This widened surface 38 is adapted to receive the application of the force in an essentially perpendicular direction to the axis of the prop, that allows the unblocking of the operative position of the prop.

The functioning of the device to aid the unloading 1 of props is the following. Whilst adjusting the length of the prop so that the upper shaft 6 comes into contact with the constructive element to be supported, the device to aid the unloading 1 must be in operative position. In this operative position, the separation distance between the first body 2 and the second body 3 is the maximum possible for its coupling, as shown in FIG. 3, since there is contact between the respective transversal protuberances 11 and 12 of the first and second projections 9 and 10. Getting the device object of the invention to adopt the operative position is done quickly and easily by moving the intermediate unloading wedge 4, from an inoperative position, in the direction that is indicated by the arrow of FIG. 6, until the ends that are folded inwards 37 of the retaining means 8 go over the third bevelled surfaces 24 of the first projections 9, protruding from the through-hole 7 and therefore also the upper shaft 6 of the prop.

To aid the unloading of the prop, it is only necessary to apply to the widened surface 38, as explained above, a force in an essentially perpendicular direction to the axis of the prop, e.g. by hitting with a hammer or similar on said widened surface 38, to move the intermediate unloading wedge 4 in the opposite direction to the previous.

To go from the operative position to the inoperative one and vice versa, you must overcome in both cases the resistance of the retention spring to the increase in the separation distance between the ends that are folded inwards 37. The slope of the third bevelled surface 24 of the first projection 9 of each body 2 and 3 and the cylindrical configuration of the exterior surface of said projection aid the transition from one position to the other, as long as you apply sufficient force overcome the retention force that the retaining means 8 exert. Thus, as you have to overcome the force applied at a certain threshold value, this stops the props unloading accidentally.

The retaining means 8, that make sure that the intermediate unloading wedge 4 does not move accidentally, are particularly essential when the sloping of the wedge is not very marked, in which case the intermediate unloading shaft is sufficiently blocked, by the pressure of the annular bodies 2 and 3 against said wedge, when the prop, in the operative position, supports the work load.

It should be mentioned that the second inferior body 3, could also be essential supporting, in this case, the intermediate unloading wedge 4 directly over the upper surface of the adjusting nut 29. Nevertheless, the direct contact of the intermediate unloading wedge 4 with the adjusting nut 29, especially when the prop goes from the operative position to the inoperative position, can cause a certain accelerated wear or cause faults with time, due to the forced friction, in the adjusting nut 29 or in the intermediate unloading wedge 4. The incorporation of the two annular bodies 2 and 3, that remain fixed with respect to the respective upper and lower shafts, resolves said drawback, since the intermediate unloading wedge 4 does not directly rest on any prop component.

The invention claimed is:

1. A device to aid the unloading of a support element having a lower shaft and an upper shaft telescopically coupled to each other and extending in a longitudinal direction, the device comprising:

an annular first body and an annular second body configured to be coaxially coupled to each other, wherein the first body and the second body are each provided with a through-hole, the through holes being adapted so that when the first body is coupled to the second body, the upper shaft can pass through the through holes and be supported by said first body, and wherein the second body is configured to be supported by the lower shaft; and an intermediate unloading wedge configured to be positioned between the first body and the second body when the first body and the second body are coupled together, the intermediate unloading wedge configured to slide in a direction transverse to the longitudinal direction, wherein the sliding of the intermediate unloading wedge causes, when the support element is in a vertical position, the first body and the second body to come together or move apart in the longitudinal direction of the support element and, therefore, reduce or increase the total length of the support element;

wherein the intermediate unloading wedge comprises an oblong annular body formed by two parallel side portions and two arched end portions, wherein the two parallel side portions have a top surface and a bottom surface angled with respect to each other such that the two parallel side portions form a wedge;

wherein the first body and the second body each comprise an opposing face with a slope that corresponds to a slope formed by a respective one of the top surface and the bottom surface of the of the two parallel side portions, when the first body and the second body are coupled with each other and the intermediate unloading wedge is disposed between the first body and the second body.

2. The device to aid the unloading of a support element according to claim 1, wherein the intermediate unloading wedge comprises a retaining device such that when the device is in an operative position, the retaining device prevents the intermediate loading wedge from moving with respect to the first body and the second body and thereby fix a separation distance between the first body and the second body;

wherein, when the device is removed from the operative position and placed in an inoperative position, the distance between the first body and the second body is reduced.

3. The device to aid the unloading of a support element according to claim 2, wherein the first body and the second body each have a first projection and a second projection, the first projection and the second projection being diametrically opposite one other;

wherein each projection originates from an internal base of a respective one of the first body and the second body, and each projection extends by an equal length from the respective internal base;

wherein each projection comprises a radially-inward facing surface that forms a portion of a cylinder, the radially-inward facing surface being coaxial with a respective through-hole;

wherein each projection comprises a cantilevered protuberance extending in a direction transverse to a respective projection;

wherein the first body and the second body comprise corresponding cavity disposed under each cantilevered protuberance;

wherein when the first body is coupled to the second body, each cantilevered protuberance simultaneously fits into a respective one of the cavities located on an opposite one of the first body and the second body;

wherein the internal base is configured to support the projections and corresponding cantilevered protuberances of an opposite one of the first body and the second body;

wherein the first body and the second body are configured to move in the longitudinal direction relative to each other such that the projections and corresponding protuberances are not supported by the internal base of the opposite one of the first body and the second body when the device is in the operative position.

4. The device to aid the unloading of a support element according to claim 3, wherein the internal bases comprise vertical end stop portions adapted to limit a rotation of the first body relative to the second body when the first body is coupled to the second body.

5. The device to aid the unloading of a support element according to claim 4, wherein each vertical end stop portion is coplanar with a respective one of an opposing interior face of the two parallel side portions.

6. The device to aid the unloading of a support element according to claim 3, wherein each first projection and each second projection of the first body and the second body have, on a face opposite the corresponding cantilevered protuberance, a bevelled surface parallel to an opposing interior face of a respective one of the two parallel side portions of the intermediate unloading wedge, so that the bevelled surfaces form guides for the intermediate unloading wedge when the intermediate unloading wedge slides with respect to the first body and the second body;

wherein each bevelled surface is guided along a respective vertical end stop wall of a base of an opposite one of the first body and the second body.

7. The device to aid the unloading of a support element according to claim 6, wherein at least each first projection of the first body and the second body comprise a second bevelled surface on a face opposite the cantilevered protuberance, wherein the second bevelled surface is adjacent to the bevelled surface.

8. The device to aid the unloading of a support element according to claim 7, wherein, in the operative position of the support element the second bevelled surfaces of the first projections of each of the first body and the second body form non-return surfaces for the retaining device of the intermediate unloading wedge.

9. The device to aid the unloading of a support element according to claim 1, wherein one of the arched ends of the intermediate unloading wedge comprises a peripheral groove, wherein ends of the peripheral groove coincide with two through-holes made in the two parallel side portions of the intermediate unloading wedge.

10. The device to aid the unloading of a support element according to claim 9, wherein a retaining device is positioned on the peripheral groove of the intermediate unloading wedge.

11. The device to aid the unloading of a support element according claim 9, wherein the retaining device comprises a retention spring comprising an arched portion, wherein the retention spring is adapted to be housed in the peripheral groove of the intermediate unloading wedge wherein the retention spring further comprises two ends that are folded inwards, wherein each of the two ends of the retention spring are configured to fit into a respective one of the through-holes of the intermediate unloading wedge.

12. The device to aid the unloading of a support element according to claim 9, wherein the upper arched portion of the intermediate unloading wedge which has the peripheral groove has a widened surface adapted to receive the application of a force in a direction transverse to the longitudinal direction.

13. A support element for construction, comprising a prop or falsework, that incorporates a device to aid the unloading of a support element according to claim 1.

14. The device to aid the unloading of a support element according to claim 1, wherein the support element comprises props or falsework.

15. A device to aid the unloading of a support element having a lower shaft and an upper shaft telescopically coupled to each other and extending in a longitudinal direction, the device comprising:

an annular first body and an annular second body configured to be coaxially coupled to each other, wherein the first body and the second body are each provided with a through-hole, the through holes being adapted so that when the first body is coupled to the second body, the upper shaft can pass through the through holes and be supported by said first body, and wherein the second body is configured to be supported by the lower shaft; and an intermediate unloading wedge configured to be positioned between the first body and the second body when the first body and the second body are coupled together, the intermediate unloading wedge configured to slide in a direction transverse to the longitudinal direction, wherein the sliding of the intermediate unloading wedge causes, when the support element is in a vertical position, the first body and the second body to come together or move apart in the longitudinal direction of the support element and, therefore, reduce or increase the total length of the support element;

wherein the intermediate unloading wedge comprises a retaining device such that when the device is in the operative position, the retaining device prevents the intermediate loading wedge from moving with respect to the first body and the second body and thereby fix a separation distance between the first body and the second body;

wherein, when the device is removed from the operative position and placed in an inoperative position, the distance between the first body and the second body is reduced;

wherein the first body and the second body each have a first projection and a second projection, the first projection and the second projection being diametrically opposite one other;

wherein each projection originates from an internal base of a respective one of the first body and the second body, and each projection extends by an equal length from the respective internal base;

wherein each projection comprises a radially-inward facing surface that forms a portion of a cylinder, the radially-inward facing surface being coaxial with a respective through-hole;

wherein each projection comprises a cantilevered protuberance extending in a direction transverse to a respective projection;

wherein the first body and the second body comprise a corresponding cavity disposed under each cantilevered protuberance;

wherein when the first body is coupled to the second body, each cantilevered protuberance simultaneously fits into a respective one of the cavities located on an opposite one of the first body and the second body;

wherein the internal base is configured to support the projections and corresponding cantilevered protuberances of an opposite one of the first body and the second body;

wherein the first body and the second body are configured to move in the longitudinal direction relative to each other such that the projections and corresponding protuberances are not supported by the internal base of the opposite one of the first body and the second body when the device is in the operative position.

* * * * *